US009441422B2

(12) United States Patent
DiSantis

(10) Patent No.: US 9,441,422 B2
(45) Date of Patent: Sep. 13, 2016

(54) CUTTING INSERT FOR A ROCK DRILL BIT

(71) Applicant: National Oilwell DHT, L.P., Houston, TX (US)

(72) Inventor: Joseph R DiSantis, Houston, TX (US)

(73) Assignee: NATIONAL OILWELL DHT, L.P., Houston, TX (US)

( * ) Notice: Subject to any disclaimer, the term of this patent is extended or adjusted under 35 U.S.C. 154(b) by 324 days.

(21) Appl. No.: 14/013,768

(22) Filed: Aug. 29, 2013

(65) Prior Publication Data

US 2014/0060934 A1 Mar. 6, 2014

Related U.S. Application Data

(60) Provisional application No. 61/694,652, filed on Aug. 29, 2012.

(51) Int. Cl.

| | |
|---|---|
| ***E21B 10/56*** | (2006.01) |
| ***E21B 7/00*** | (2006.01) |
| ***E21B 10/55*** | (2006.01) |
| ***E21B 10/567*** | (2006.01) |

(52) U.S. Cl.

CPC ..... *E21B 10/56* (2013.01); *E21B 7/00* (2013.01); *E21B 10/55* (2013.01); *E21B 10/5673* (2013.01)

(58) Field of Classification Search

CPC ..... E21B 10/55; E21B 10/5673; E21B 2010/545; E21B 2010/562

See application file for complete search history.

(56) References Cited

U.S. PATENT DOCUMENTS

| | | | | |
|---|---|---|---|---|
| 3,388,757 | A * | 6/1968 | Fittinger | E21B 10/56 175/426 |
| 4,333,540 | A | 6/1982 | Daniels et al. | |
| 4,529,048 | A | 7/1985 | Hall | |
| 4,570,726 | A | 2/1986 | Hall | |
| 4,593,777 | A | 6/1986 | Barr | |
| 4,716,977 | A * | 1/1988 | Huffstutler | E21B 10/52 175/426 |
| 4,724,913 | A | 2/1988 | Morris | |
| 4,819,516 | A | 4/1989 | Dennis | |
| 4,928,777 | A * | 5/1990 | Shirley-Fisher | E21B 10/5673 175/430 |
| 5,115,873 | A | 5/1992 | Pastusek | |
| 5,201,376 | A | 4/1993 | Williams | |
| 5,746,280 | A | 5/1998 | Scott et al. | |
| 5,819,861 | A * | 10/1998 | Scott | E21B 10/006 175/371 |

(Continued)

FOREIGN PATENT DOCUMENTS

| | | | | |
|---|---|---|---|---|
| GB | 2353056 A | * | 2/2001 | E21B 10/5673 |
| WO | 2014/036283 A1 | | 3/2014 | |
| WO | WO 2015161010 A2 | * | 10/2015 | E21B 10/5673 |

OTHER PUBLICATIONS

MEGADIAMOND IND. promotional book; Dec. 6, 1983; Houston, Texas; pp. 1-17.

(Continued)

*Primary Examiner* — Jennifer H Gay

(74) *Attorney, Agent, or Firm* — Conley Rose, P.C.

(57) ABSTRACT

A cutting insert for a rock drill bit having a ridge formed on a cutting face that splits extrudate formed during drilling thereby reducing the mechanical specific energy that may be expended to move the extrudate across the cutting face. The cutting insert may have a cutting edge which forms the extrudate during drilling and a face having two opposing, generally symmetrical, concave regions that define an elongated ridge therebetween. The ridge may extend across a substantial portion of the face.

18 Claims, 4 Drawing Sheets

(56) References Cited

U.S. PATENT DOCUMENTS

| | | | | |
|---|---|---|---|---|
| 5,992,549 | A | 11/1999 | Fuller | |
| 6,045,440 | A * | 4/2000 | Johnson | E21B 10/5673 175/432 |
| 6,065,554 | A | 5/2000 | Taylor et al. | |
| 6,131,678 | A | 10/2000 | Griffin | |
| 6,209,668 | B1 * | 4/2001 | Pessier | E21B 10/006 175/331 |
| 6,241,035 | B1 * | 6/2001 | Portwood | B23P 15/28 175/374 |
| 6,328,117 | B1 | 12/2001 | Berzas et al. | |
| 6,332,503 | B1 | 12/2001 | Pessier et al. | |
| 6,601,662 | B2 * | 8/2003 | Matthias | B22F 7/06 175/374 |
| 7,588,102 | B2 * | 9/2009 | Hall | E21B 10/5673 175/425 |
| 7,681,673 | B2 | 3/2010 | Kolachalam | |
| 7,726,420 | B2 | 6/2010 | Shen et al. | |
| 7,798,257 | B2 | 9/2010 | Shen et al. | |
| 8,037,951 | B2 | 10/2011 | Shen et al. | |
| 8,739,904 | B2 * | 6/2014 | Patel | E21B 10/52 175/428 |
| 8,783,387 | B2 * | 7/2014 | Durairajan | E21B 10/5673 175/426 |
| 9,051,795 | B2 * | 6/2015 | Hall | E21B 10/5735 |
| 9,074,435 | B2 * | 7/2015 | Scott | E21B 10/42 |
| 2005/0247492 | A1 * | 11/2005 | Shen | E21B 10/5735 175/426 |
| 2008/0060852 | A1 * | 3/2008 | Chandila | E21B 10/16 175/374 |
| 2008/0099251 | A1 * | 5/2008 | Hall | E21B 10/5673 175/428 |
| 2009/0159341 | A1 * | 6/2009 | Pessier | E21B 10/56 175/341 |
| 2010/0059287 | A1 * | 3/2010 | Durairajan | E21B 10/5673 175/420.2 |
| 2010/0163310 | A1 * | 7/2010 | Vempati | E21B 10/43 175/57 |
| 2011/0031036 | A1 * | 2/2011 | Patel | E21B 10/52 175/430 |
| 2011/0266070 | A1 * | 11/2011 | Scott | E21B 10/42 175/428 |
| 2013/0199856 | A1 | 8/2013 | Bilen et al. | |
| 2014/0060934 | A1 * | 3/2014 | DiSantis | E21B 10/56 175/57 |
| 2014/0182947 | A1 * | 7/2014 | Bhatia | E21B 10/46 175/327 |
| 2014/0183800 | A1 * | 7/2014 | Stewart | E21B 10/46 264/671 |
| 2014/0196959 | A1 * | 7/2014 | Hall | E21B 10/5735 175/432 |

OTHER PUBLICATIONS

International Search Report for PCT Patent Application No. PCT/US2013/57322 dated Jan. 17, 2014, 2 pages.

United Kingdom Examination Report under section 18(3) dated Jul. 22, 2015 for counterpart United Kingdom Application No. 1502841.8, 1 page.

Canadian Examiner's Report dated Mar. 17, 2016 for Canadian Application No. 2,882,310, 4 pages.

Response to United Kingdom Examination Report dated Jul. 22, 2015 for United Kingdom Application No. 1502841.8, 10 pages.

Written Opinion of the International Searching Authority dated Jan. 17, 2014 for PCT/US2013/057322, 4 pages.

International Report on Patentability dated Mar. 3, 2015 for PCT/US2013/057322, 5 pages.

* cited by examiner

CUTTING INSERT FOR A ROCK DRILL BIT

CROSS-REFERENCE TO RELATED APPLICATION

This application claims the benefit of U.S. Provisional Application No. 61/694,652, the entire contents of which are hereby incorporated by reference.

BACKGROUND OF THE INVENTION

1. Field of the Invention

The present invention relates generally to a cutting insert for a rock drill bit useful in drilling subterranean boreholes and, in one or more embodiments, to such a cutting insert that significantly reduces the mechanical specific energy expended to extrude crushed rock particles across the face of a polycrystalline diamond cutting insert thereby effectively increasing the efficiency of a rock drill bit during drilling a subterranean borehole.

2. Description of Related Art

In the production of fluid, from subterranean environs, a borehole may be drilled in a generally vertical, deviated or horizontal orientation so as to penetrate one or more subterranean locations of interest. Typically, a borehole may be drilled by using drill string which may be made up of tubulars secured together by any suitable means, such as mating threads, and either a fixed cutter type or a roller cone type rock drill bit secured at or near one end of the drill string. Drilling operations may also include other equipment, for example hydraulic equipment, mud motors, rotary tables, whipstocks, as will be evident to the skilled artisan. Drilling fluid may be circulated via the drill string from the drilling rig to the rock drill bit. The drilling fluid may entrain and remove cuttings from subterranean rock face adjacent the rock drill bit and thereafter may be circulated back to the drilling rig via the annulus between the drill string and borehole. After drilling, the borehole may be completed to permit production of fluid, such as hydrocarbons, from the subterranean environs.

As drilling a borehole is typically expensive, for example up to $500,000 per day, and time consuming, for example taking up to six months or longer to complete, increasing the efficiency of drilling a borehole to reduce cost and time to complete a drilling operation is important. Historically, drilling a borehole has proved to be difficult since an operator of the drilling rig typically does not have immediate access to, or the ability to make decisions based upon detailed rock mechanical properties and must rely on knowledge and experience to change those drilling parameters that are adjustable. Where a drilling operator has no previous experience in a given geological area, the operator must resort to trial and error to determine the most favorable settings for those adjustable drilling parameters. Processes have been proposed which utilize a traditional calculation of mechanical specific energy (MSE), which is the summed total of two quantities of energy delivered to the subterranean rock being drilled: torsional energy and gravitational energy, and manual adjustment of drilling parameters as a result of such calculation in an attempt to increase drilling efficiency. The original calculation developed by Teale, R. (1965) is as follows:

$$MSE=(W_b/A_b)+((120*\pi*RPM*T)/(A_b*ROP))$$

Where:

MSE=Mechanical Specific Energy (psi)

$W_b$=Weight on Bit (pounds)

$A_b$=Surface area of the bit face, or borehole area ($in^2$)

RPM=revolutions per minute

T=torque (ft-lbf)

ROP=rate of penetration (ft/hr)

The basis of MSE is that there is a measurable and calculable quantity of energy required to destroy a unit volume of subterranean rock. Operationally, this energy is delivered to the rock by rotating (torsional energy) and applying weight to (gravitational energy) a rock drill bit via the drill string. Historically, drilling efficiency could then be gauged by comparing the compressive strength of the rock against the quantity of energy used to destroy it.

Current drilling operations are regularly conducted in such a way that directly increases rate of penetration (ROP) of a rock drill bit through an environ. Traditional mechanical specific energy (MSE) theory posits that if one can minimize MSE while drilling, a resulting increase in ROP will be observed as is defined within the calculation of MSE. It is presently widely accepted by the oil and gas industry that even good drilling operations have a MSE efficiency factor of approximately 35%, i.e. only 35% of the energy put into the drilling operation actually goes towards destroying subterranean rock. While this initial 35% of MSE expenditure goes toward failing the subterranean rock, some portion of the remaining 65% of MSE is expended to collectively extrude crushed rock particles across the face of each cutting insert of a rock drill bit while drilling.

Prior efforts have been focused on developing resilient, high strength inserts having at least a polycrystalline diamond ("PCD") cutting face that is designed for hard rock abrasion. There have been many advancements in fabrication processes associated with sintering the PCD layer onto a back-supporting substrate material, e.g.—tungsten carbide, of an insert, sorting of the diamond particles in the PCD layer, and general materials selection. However, improvements to the configuration of the cutting insert have largely been focused on increasing performance based on preserving traits derived from these advancements.

Thus, a need still exists for a cutting insert configuration that effectively reduces the mechanical specific energy that is expended to extrude crushed rock particles across the face of a cutting insert during drilling.

BRIEF SUMMARY OF THE INVENTION

To achieve the foregoing and other objects, and in accordance with the purposes of the present invention, as embodied and broadly described herein, one embodiment of the present invention is a cutting insert for a rotary rock drill bit. The cutting insert comprises a cutting edge and a face having two opposing, concave regions that define an elongated ridge therebetween. The ridge extends across a substantial portion of said face.

Another embodiment of the present invention is a rotary rock drill bit comprising a body and at least one cutting insert secured to the body. Each of the at least one cutting insert comprises a cutting edge and a face having two opposing, concave regions that define an elongated ridge therebetween. The ridge extends across a substantial portion of the face.

Still another embodiment of the present invention is a method of drilling subterranean boreholes comprising forming an extrudate by means of a cutting edge of at least one cutting insert of a rock drill bit and splitting the extrudate at a location proximate to the cutting edge. Splitting is accomplished by means of a ridge formed on a cutting face of the at least one cutting insert thereby reducing the mechanical specific energy that is expended to move the extrudate across the cutting face.

BRIEF DESCRIPTION OF THE SEVERAL VIEWS OF THE DRAWINGS

The accompanying drawings, which are incorporated in and form a part of the specification, illustrate the embodiments of the present invention and, together with the description, serve to explain the principles of the invention.

In the drawings.

DETAILED DESCRIPTION OF THE INVENTION

The inserts of the present invention and assemblies and processes employing the inserts may be utilized and deployed in a borehole which may be formed by any suitable means, such as by a rotary drill string, as will be evident to a skilled artisan. As used throughout this description, the term "borehole" is synonymous with wellbore and means the open hole or uncased portion of a subterranean well including the rock face which bounds the drilled hole. A "drill string" may be made up of tubulars secured together by any suitable means, such as mating threads, and a rock drill bit secured at or near one end of the tubulars as secured together. The borehole may extend from the surface of the earth, including a sea bed or ocean platform, and may penetrate one or more environs of interest. As used throughout this description, the terms "environ" and "environs" refers to one or more subterranean areas, zones, horizons and/or formations that may contain hydrocarbons. The borehole may have any suitable subterranean configuration, such as generally vertical, generally deviated, generally horizontal, or combinations thereof, as will be evident to a skilled artisan. The quantity of energy referred to as "energy of extrusion" or "Ee" means the portion of the total MSE mechanical specific energy (MSE) that is expended to extrude crushed rock particles across the faces of all cutting inserts of a rock drill bit during drilling. As used throughout this description, the term "extrudate" refers to crushed rock particle conglomerates that are extruded across the face of a cutting insert during drilling. As also used throughout this description, the term "rock drill bit" refers to a fixed cutter, drag-type rock drill bit.

Figure 1:
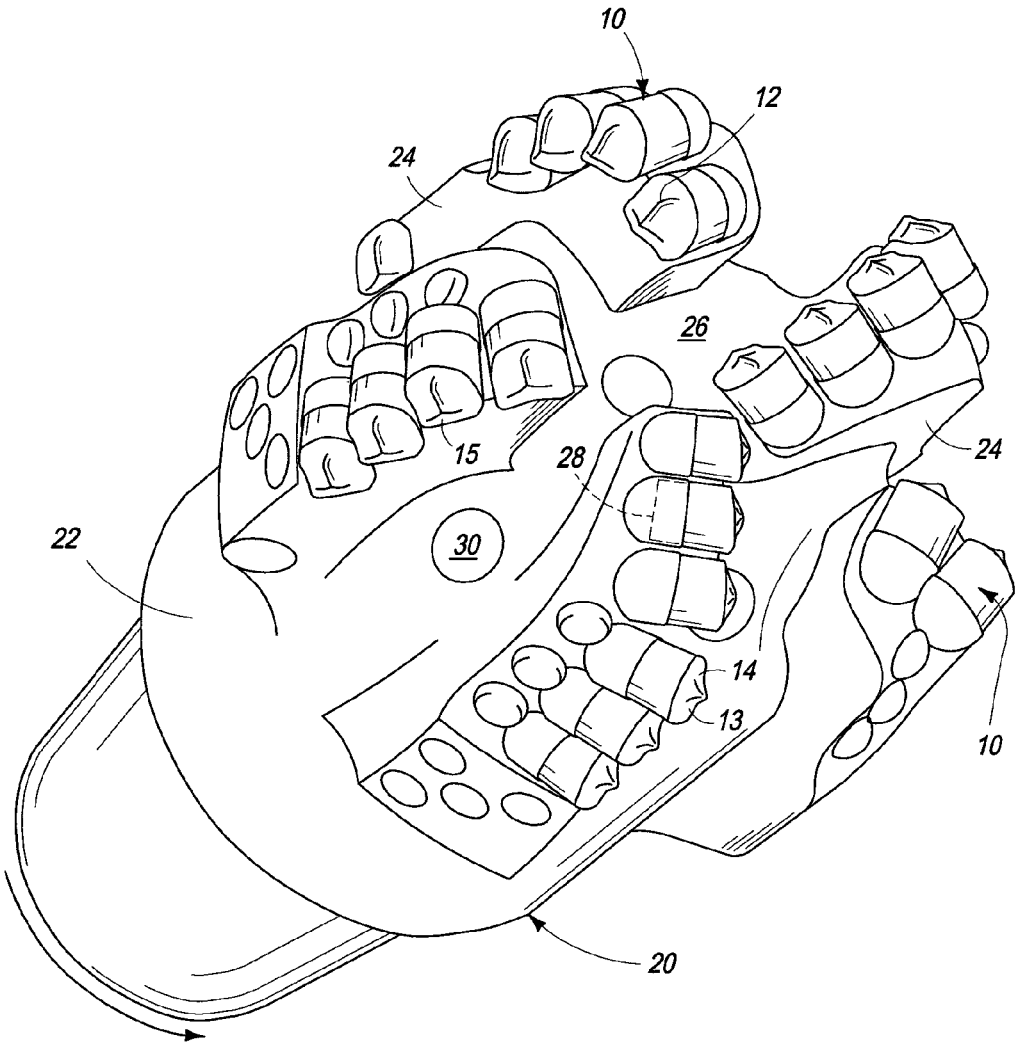
FIG. 1 is a perspective view of a rock drill bit having a plurality of cutting inserts of the present invention secured thereof.
Figure 2:
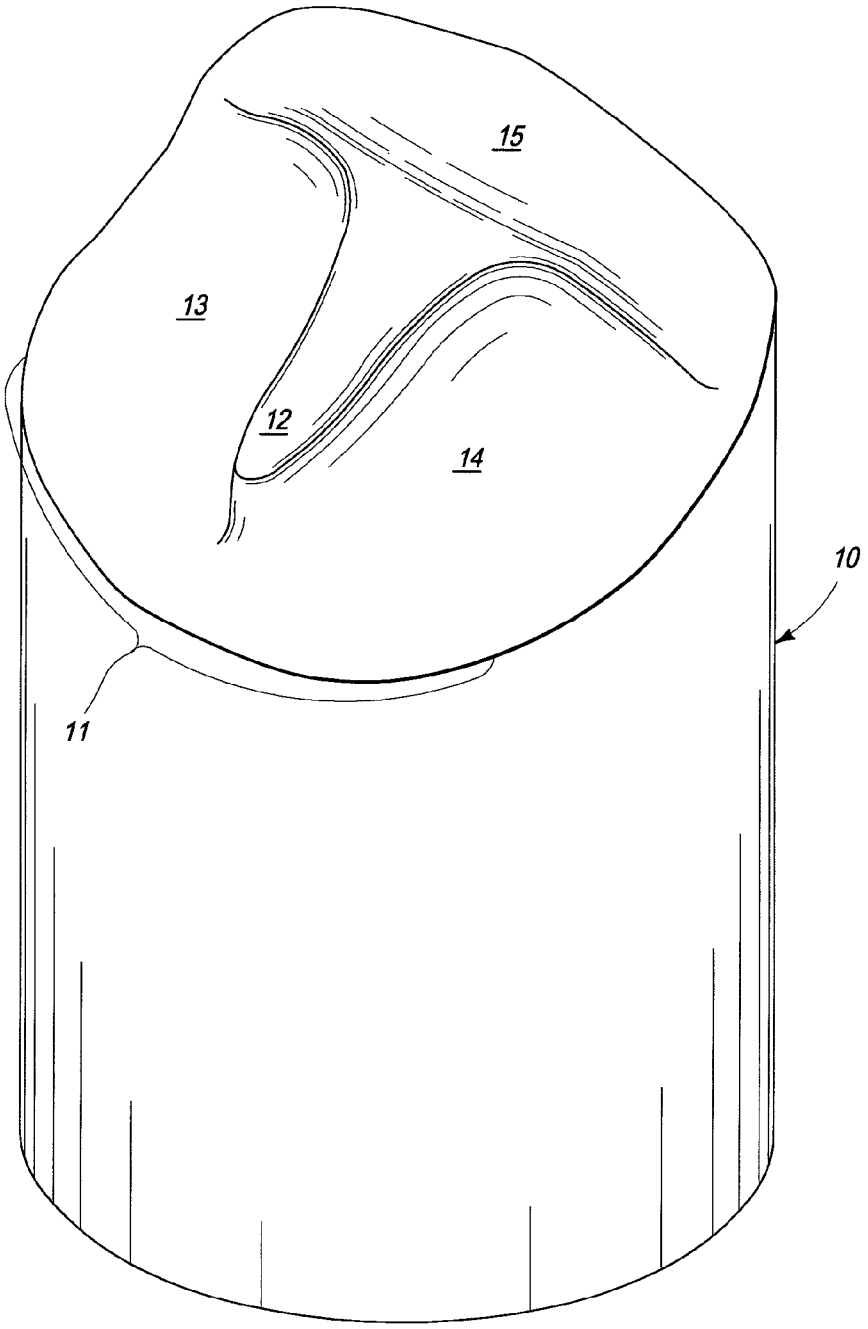
FIG. 2 is a perspective view of one embodiment of a cutting insert of the present invention illustrated.
Figure 3:
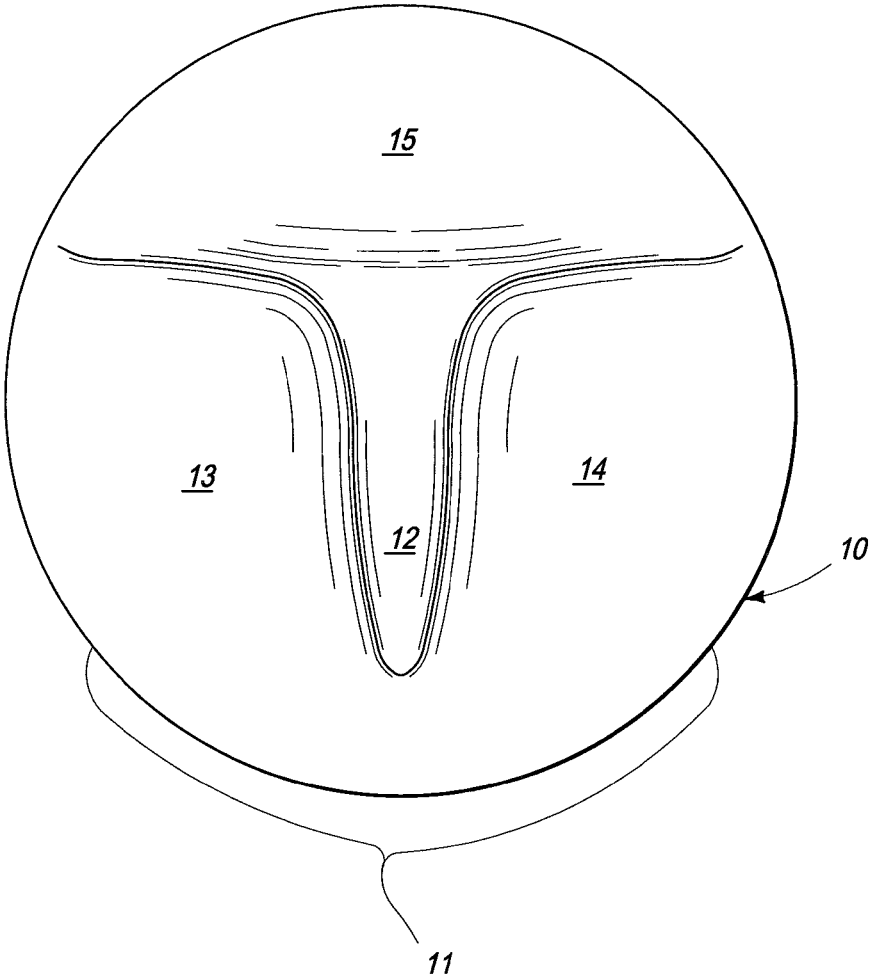
FIG. 3 is a top view of the embodiment of a cutting insert of the present invention illustrated in FIG. 2.
Figure 4:
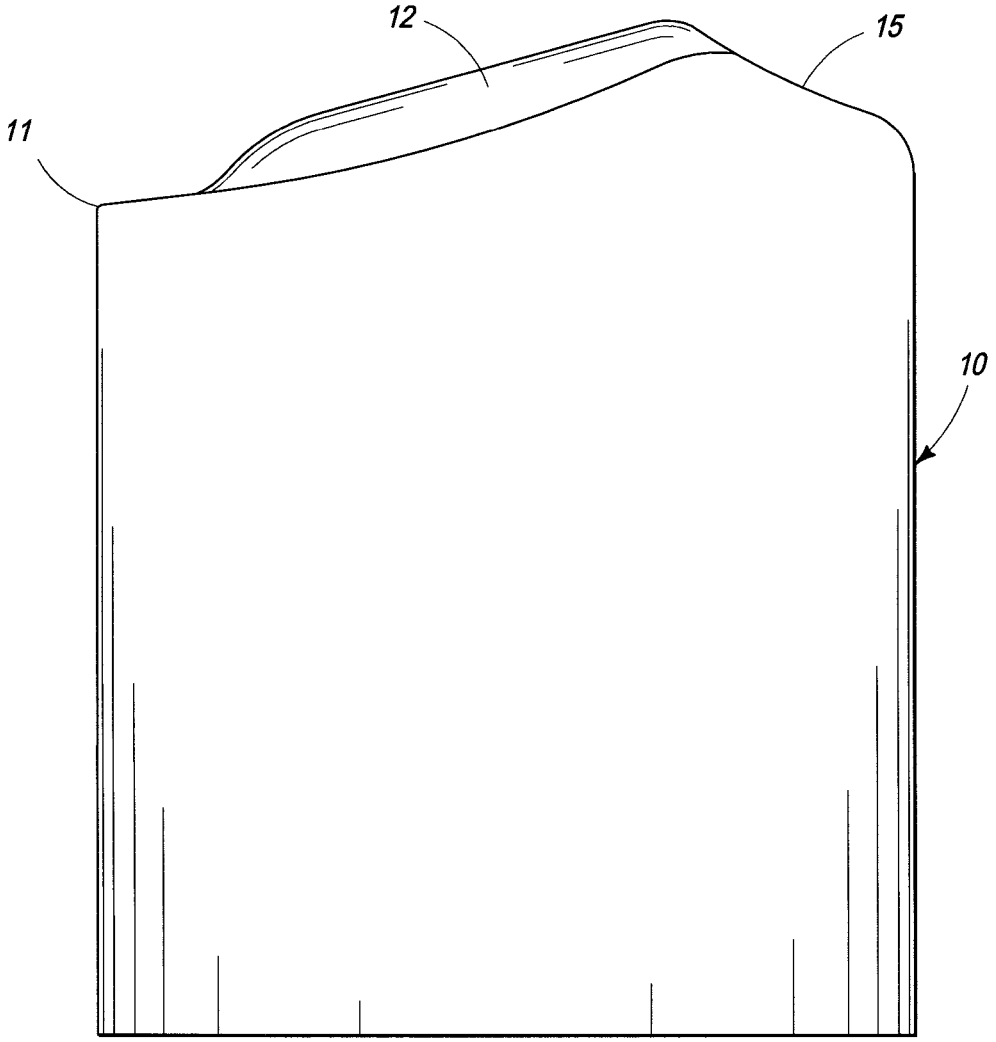
FIG. 4 is a side view of the embodiment of a cutting insert of the present invention illustrated in FIG. 2.

The cutting inserts of the present invention may be utilized in conjunction with any rock drill bit which is rotated by means of a drill string to form a borehole in environs, such as a rotary drag-type rock drill bits. A drag-type rock drill bit 20 is illustrated in FIG. 1 as having a bit body 22 which may include one or more blades 24 which may protrude from the outer periphery of the bit body, may extend along a substantial portion of the bit body and terminate on or near the distal end 26 thereof. One or more cutting inserts 10 may be mounted in at least one of the blades 24 by positioning a portion of each cutting insert 10 within a separate socket 28 and securing it therein by any suitable means as will be evident to a skilled artisan, for example by means of pressure compaction or baking at high temperature into the matrix of the bit body. The bit body may also be provided with one or more passages 30 for transporting drilling fluid to the surface of the bit body for cooling and/or cleaning the exposed portion of the cutting inserts 10 during drilling operations. Each cutting insert may preferably have a polycrystalline diamond ("PCD") portion bonded to a less hard substrate, typically with the PCD positioned outside of the bit body as the cutting insert is mounted. The cutting insert may have any suitable general configuration as will be evident to a skilled artisan, for example a generally cylindrical configuration, and preferably has generally constant diameter along substantially the entire length thereof, for example 13 mm.

The exposed end of each cutting insert as mounted in bit body 24 includes geometric partitions of the surface area, each having its own functional role in abrading/shearing, excavating, and removing rock from beneath the bit during rotary drilling operations. The configuration of the cutting inserts of the present invention does not affect their depth of cut into the rock that is being drilled, but does interrupt the extrudate formation in such a way that limits the volume and mass (less energy of formation) of the extrudate. In this manner, an increased surface area of the extrudate is more rapidly exposed to the drilling fluid during drilling, thereby subjecting the extrudate to greater dynamic fluid forces and resulting in its removal with less Ee. Accordingly, less input energy is required to drill at given rate of penetration, thereby reducing MSE while drilling. Accordingly, if constant mechanical specific energies are maintained, faster rates of penetration should be observed as a higher percentage of the total MSE will be directed towards failing the intact rock under the bit, assuming that proper bit hydraulics exist to clear away the extrudate at the faster penetration rates.

As illustrated in FIGS. 1-4, the cutting insert 10 of the present invention may be configured to provide a cutting edge which is that portion of the edge of the insert 10 illustrated as being within the bracket 11 and is dimensioned to achieve a generally predetermined depth-of-cut into the rock. The outer end face (cutting face) of the cutting insert may have two opposing, generally symmetrical, concave regions 13 and 14 which define an elongated ridge 12 therebetween. The outer end face (cutting face) may be preferably formed of polycrystalline diamond. Ridge 12 may preferably be generally perpendicular to the cutting edge 11 and may be preferably centrally oriented along the outer end face. Region 15 provides rigid back-support and stability to the curvatures of Regions 13 and 14. Preferably, ridge 12 extends from a point proximate to cutting edge 11 across a significant portion of the cutting face of the insert to a location at or near region 15 thereby defining a protrusion having significant length to bisect and physically split apart extruding rock particle conglomerates or extrudates and direct the smaller, split extrudate portions into Regions 13 and 14. Ridge 12 preferably may have a substantially uniform width along the entire length thereof and may have substantially uniform height along the entire length thereof or may possess a height that varies, such as by increasing from the end thereof proximate to cutting edge 11 to the other end thereof at a location at or near region 15. The portion of MSE required to split extrudates into portions and to direct the smaller extrudate portions into Regions 13 and 14 may be significantly less that the portion of the MSE required to extrude or move extrudates across the face of a polycrystalline diamond cutting insert without splitting. In addition, the geometry of Regions 13 and 14 may reduce the distance an extrudate portion must travel in a high pressure fluid environment before being broken off and exiting from the outer end face (cutting face) of the cutting insert.

In those embodiments where the cutting insert is placed along the side of a rock drill bit as well as along the distal end thereof, such as the embodiment illustrated in FIG. 1, the orientation of the cutting inserts 10 will vary so as to ensure that cutting edge 10 of each insert is may achieve its intended depth of cut, or at least be in contact with the rock during drilling. The direction of rotation of the rock drill bit is as indicated by the arrow at the bottom of FIG. 1. As further illustrated in FIG. 1, the orientation of the cutting inserts 10 positioned at the distal end of the bit 20 may be 90° offset from the orientation of those cutting inserts 10 positioned along the side wall of the bit body.

Concave regions 13 and 14 preferably may possess mirror symmetry relative to each other about the axis of ridge 12, and are concave to such a degree that the surface curvatures apply directionally opposing forces to the extrudates at increasingly positive non-zero angles to the two-dimensional plane of cutting edge 11, literally forcing the extrudates into the drilling fluid until such point in time when the surface area of each extrudate exceeds a critical value and the extrudate is broken off into the flow regime of the drilling fluid. The critical value of surface area of the smaller, split extrudate portion in either of regions 13 or 14 is equal to or greater than that of an extrudate portion having a mass, shape and volume that cannot possess enough internal static friction to resist the external dynamic hydraulic forces of the drilling fluid. Dynamic hydraulic forces that exceed what the smaller, split extrudate portion can internally support may result in its removal from Region 13 or 14 and allow for the rock drill bit to continue excavating rock. Preferably, concave regions 13 and 14 each have a length of surface curvature that is less than the diameter of the cutting insert. Further, the length from cutting edge 11 to the juncture of back-support region 15 to either of concave regions 13 or 14 is preferably less than the diameter of the cutting insert.

While the foregoing preferred embodiments of the invention have been described and shown, it is understood that the alternatives and modifications, such as those suggested and others, may be made thereto and fall within the scope of the invention.

I claim:

1. A cutting insert for a rotary rock drill bit comprising:
a cutting edge; and
a face extending from the cutting edge;
wherein the face includes two opposing concave regions that define an elongated ridge therebetween and a back-support region;
wherein said ridge has a first end proximal the cutting edge and a second end distal the cutting edge, wherein said ridge extends across a substantial portion of said face, wherein the first end of said ridge is positioned a distance from said cutting edge and points towards said cutting edge, and wherein the second end of said ridge intersects the back-support region;
wherein the back-support region is positioned on the face opposite the cutting edge and is oriented substantially perpendicular to the ridge;
wherein the ridge extends to a height that increases moving from the first end to the back-support region.

2. The cutting insert of claim 1 wherein the face is polycrystalline diamond.

3. The cutting insert of claim 1 wherein the ridge is generally linear.

4. The cutting insert of claim 1 wherein the ridge is substantially perpendicular to the cutting edge.

5. The cutting insert of claim 1 wherein the concave regions are generally symmetrical.

6. The cutting insert of claim 1 wherein said cutting insert is substantially cylindrical.

7. The cutting insert of claim 1 wherein the ridge extends from the first end proximate to the cutting edge across a significant portion of the cutting face.

8. The cutting insert of claim 1 wherein each of the two, opposing concave regions have a length of surface curvature that is less than the diameter of the cutting insert.

9. The cutting insert of claim 1 wherein a length from the cutting edge to the juncture of either of the two, opposing concave regions with the back-support region of the face is less than the diameter of the cutting insert.

10. A rotary rock drill bit comprising:
a body;
at least one cutting insert secured to said body, each of said at least one cutting insert comprising:
a cutting edge; and
a face extending from the cutting edge;
wherein the face includes two opposing concave regions that define an elongated ridge therebetween and a back-support region;
wherein said ridge has a first end proximal the cutting edge and a second end distal the cutting edge, wherein said ridge extends across a substantial portion of said face, wherein the first end of said ridge is positioned a distance from said cutting edge and points towards said cutting edge and wherein the second end of said ridge intersects the back-support region,
wherein the back-support region is positioned on the face opposite the cutting edge and is oriented substantially perpendicular to the ridge;
wherein the ridge extends to a height that increases moving from the first end to the back-support region.

11. The rotary rock drill bit of claim 10 wherein said body comprises a blade which protrudes from an outer periphery of the bit-body, the at least one cutting insert being secured to the blade.

12. The rotary rock drill bit of claim 10 wherein the ridge is generally linear.

13. The rotary rock drill bit of claim 10 wherein the ridge is substantially perpendicular to the cutting edge.

14. The rotary rock drill bit of claim 10 wherein the concave regions are generally symmetrical.

15. The rotary rock drill bit of claim 10 wherein the ridge extends from the first end proximate to the cutting edge across a significant portion of the cutting face.

16. The rotary rock drill bit of claim 10 wherein each of the two, opposing concave regions have a length of surface curvature that is less than a diameter of the cutting insert.

17. The rotary rock drill bit of claim 10 wherein a length from the cutting edge to a juncture of either of the two, opposing concave regions with the back-support region of the face is less a diameter of the cutting insert.

18. A method of drilling subterranean boreholes comprising:
forming an extrudate with a cutting edge of at least one cutting insert of a rock drill bit; and
splitting the extrudate at a location proximate to the cutting edge with a ridge formed on a cutting face of the at least one cutting insert with a first end of said ridge to reduce a mechanical specific energy that is expended to move the extrudate across the cutting face;

wherein the cutting face extends from the cutting edge and includes the ridge and a back-support region positioned opposite the cutting edge, wherein the cutting ridge has a first end proximal the cutting edge and a second end distal the cutting edge, wherein the first end of said ridge is positioned a distance from said cutting edge and points towards the cutting edge, and wherein the second end of the cutting ridge intersects the back-support region, wherein the back-support region is oriented substantially perpendicular to the ridge, and wherein the ridge extends to a height that increases moving from the first end to the back-support region.

* * * * *